United States Patent [19]

Baur et al.

[11] 4,010,525

[45] Mar. 8, 1977

[54] METHOD FOR ASSEMBLING A FUNNEL AND A FLANGELESS FACEPLATE IN THE MANUFACTURE OF A COLOR TELEVISION PICTURE TUBE

[75] Inventors: Leslie L. Baur, Glen Ellyn; Thaddeus J. Hajduk, Chicago, both of Ill.

[73] Assignee: Zenith Radio Corporation, Chicago, Ill.

[22] Filed: May 3, 1976

[21] Appl. No.: 682,947

[52] U.S. Cl. ..... 29/25.13; 29/25.19

[51] Int. Cl.[2] ..... H01J 9/26

[58] Field of Search ..... 29/25.13, 25.19, 25.16, 29/25.15

[56] References Cited

UNITED STATES PATENTS

| | | | |
|---|---|---|---|
| 3,787,937 | 1/1974 | Palac | 29/25.13 |
| 3,807,006 | 4/1974 | Segro et al. | 29/25.13 |
| 3,816,891 | 6/1974 | Fassett | 29/25.13 |

*Primary Examiner*—Richard B. Lazarus
*Attorney, Agent, or Firm*—John R. Garrett

[57] ABSTRACT

This disclosure depicts a method for use in the manufacture of a rectangular shadow mask-type color television picture tube including a flangeless, curved faceplate having a central axis, a convex front surface, and a concave rear surface with a phosphor screen deposited on a central portion thereof. The faceplate also has four shadow mask suspension studs extending from the rear surface of the faceplate, one in each peripheral corner region of the faceplate, and a shadow mask suspended from the studs. The tube also includes a funnel having a central axis and a neck attached to a rectangularly cross-sectioned flared portion, the flared portion having a seal land which mates with the concave rear surface of the faceplate. The seal land has deposited thereon a cement for sealing the faceplate to the funnel. The flared portion of the funnel also has corner notches in at least three corners of the funnel, the notches receiving the studs on the faceplate when the faceplate and funnel are assembled, the studs and the notches constituting an internal referencing system for the faceplate and the funnel. The method for assembling the faceplate to the funnel comprises orienting the faceplate, concave rear surface down, with the faceplate central axis parallel to a predetermined reference axis and the faceplate being angularly positioned to coincide with a predetermined faceplate theta position, the orienting being effected by engaging the studs on the faceplate with simulated funnel inside corner notches on a faceplate aligning means; orienting the funnel, flared portion up, with the funnel central axis parallel to the predetermined reference axis and the funnel being angularly positioned to coincide with a predetermined funnel theta position, the orienting being effected by engaging the notches in the funnel with simulated studs on a funnel aligning means, the simulated studs and simulated notches being theta-referenced each to the other, i.e., the angular orientation of each to the other is at all times known; locking the faceplate such that the faceplate central axis is parallel to the predetermined reference axis, and such that the theta referencing to the funnel is preserved; disengaging the faceplate aligning means from the faceplate; locking the funnel such that the funnel central axis is parallel to the predetermined reference axis and such that the theta referencing to the faceplate is preserved; disengaging the funnel aligning means from the funnel; effecting relative motion of the faceplate and the funnel parallel to the reference axis and in planes perpendicular to the reference axis while preserving the theta referencing to cause the studs on the faceplate to engage the notches in the funnel.

11 Claims, 12 Drawing Figures

METHOD FOR ASSEMBLING A FUNNEL AND A FLANGELESS FACEPLATE IN THE MANUFACTURE OF A COLOR TELEVISION PICTURE TUBE

BACKGROUND OF THE INVENTION

This invention relates in general to color television picture tubes and in particular to a method for assembling the glass funnel and faceplate parts of such tubes. Conventionally, a color television picture tube has a glass bulb including a funnel and a flanged faceplate sealed to the flared end of the funnel. An electron gun assembly mounted in a neck portion of the funnel provides a source of electrons which impinge on an electron-excitable phosphor screen deposited on the concave inner surface of the faceplate.

A well-known technique for assembling the parts of a glass bulb employs a frit-type of glass sealing material. The frit is usually applied to a seal land on the flared portion of the funnel with the funnel supported in a neck-down position. A seal land on the faceplate is then superposed thereover with the two seal lands in registration with one another. The envelope assembly is then heat treated in an oven having an appropriate heat profile and time cycle to permit the frit to establish a vacuum-type seal all along the sealing interface of the faceplate and funnel.

This entire process is well understood and is successfully practiced in the production of shadow mask color picture tubes of a conventional type on a mass production basis. Great care is exercised in the fabrication of the component parts and in the various processing steps to assure proper and precise beam landing in the finished tube. For example, the seal lands of the faceplate and funnel are frequently precision ground in an effort to attain an optimum mating of these sections in the sealing process.

The method of this invention is believed to be most useful when applied to a tube having a flangeless faceplate. Such a tube is disclosed in U.S. Pat. No. 3,894,260 issued to the assignee of this application. The tube has a flangeless, curved glass faceplate, a concave inner surface of which receives a phosphor screen. The funnel portion of this unique tube has a convex, curved seal land; that is, the seal land defines a convex, curved plane which matches and mates with the curvature of the concave inner surface of the faceplate. Since the faceplate is flangeless, the sealing interface between the funnel and the faceplate is curved rather than planar as in conventional tubes.

In order to insure proper beam landings in this unique tube, an internal referencing system is provided for accurate positioning of the faceplate relative to the funnel in an assembled tube. An internal referencing system for use with this unique tube is disclosed in copending application Ser. No. 462,915 filed Apr. 22, 1974 now U.S. Pat. No. 3,971,490 and U.S. Pat. No. 3,904,914, both assigned to the assignee of this application.

Copending application Ser. No. 462,915, filed Apr. 22, 1974 discloses a unique rectangular-type color cathode ray tube in which the faceplate and the tube funnel have referencing means which define faceplate and funnel reference surfaces of such number and arrangement that the faceplate and the funnel are interlocked to prevent beyond-tolerance relative movement therebetween. In a preferred structure disclosed, the faceplate has internal referencing means in three corners. The funnel has in each of three corresponding corners an integral notch defining a pair of spaced, inside funnel reference surfaces oriented to capture the associated faceplate referencing means.

U.S. Pat. No. 3,904,914 discloses a unique rectangular-type color cathode ray tube which has an envelope, comprising an approximately rectangular, flangeless faceplate having in at least three perimetric interior regions thereof referencing means, the referencing means defining at least three faceplate reference surfaces. A funnel having an approximately rectangular mouth is sealed to the faceplate. The funnel is provided with a like number of inside funnel reference surfaces in alignment with the faceplate reference surfaces for making referencing engagement with the faceplate reference surfaces when the faceplate and funnel are assembled. The faceplate and funnel reference surfaces are of such number and arrangement as to uniquely determine and fix the location of said faceplate relative to said funnel. In a preferred embodiment, the referencing means on the faceplate comprise corner-mounted studs serving also to hold a color selection electrode for the tube.

A number of problems have been encountered in attempting to assemble a tube having a flangeless faceplate of the type described above. For example, when the faceplate is placed on the funnel by hand, it is difficult to see if the faceplate and funnel are properly aligned before lowering the faceplate onto the funnel. If not aligned, it is possible to damage the frit material located on the funnel seal land, thereby causing problems in the operation of the tube when it is fully assembled and evacuated. A high degree of precision is required to properly assemble a flangeless faceplate and a funnel of the type of tube described above. The method of this invention solves the problem of assembly for this type of tube.

OTHER PRIOR ART

U.S. Pat. No. 3,737,065; and U.S. Pat. No. 3,838,483.

OBJECT OF THE INVENTION

It is a general object of the present invention to provide for a color television picture tube having a glass bulb comprising a funnel and a flangeless faceplate an improved method for assembling the faceplate and the funnel.

It is another object of the present invention to provide a method for assembling a flangeless faceplate and a funnel having a frit material dispensed on a seal land of a flared portion thereof, which method prevents damage to the frit material during assembly of the faceplate and the funnel.

It is another object of the present invention to provide a method for assembling a funnel and a flangeless faceplate which is rapid, efficient and economical.

BRIEF DESCRIPTIONS OF THE DRAWINGS

The features of the present invention, which are believed to be novel, are set forth with particularity in the appended claims. The invention, together with further objects and advantages thereof, may best be understood by reference to the following description taken in conjunction with the accompanying drawings in which:

FIG. 1 is a perspective, exploded view showing the internal referencing system of a unique glass bulb with which this invention is most advantageously used.

FIG. 2 schematically illustrates the relationship of the angular orientations of the FIG. 1 faceplate and funnel prior to assembly.

FIGS. 3A–3G schematically illustrate the method of the present invention for assembling the FIG. 1 glass, flangeless faceplate to the FIG. 1 glass funnel.

FIGS. 4A–4C are side views of apparatus for implementing an aspect of the method of the present invention wherein the glass funnel and glass faceplate are concurrently aligned relative to one another.

DESCRIPTION OF THE PREFERRED EMBODIMENT

Figure 1:
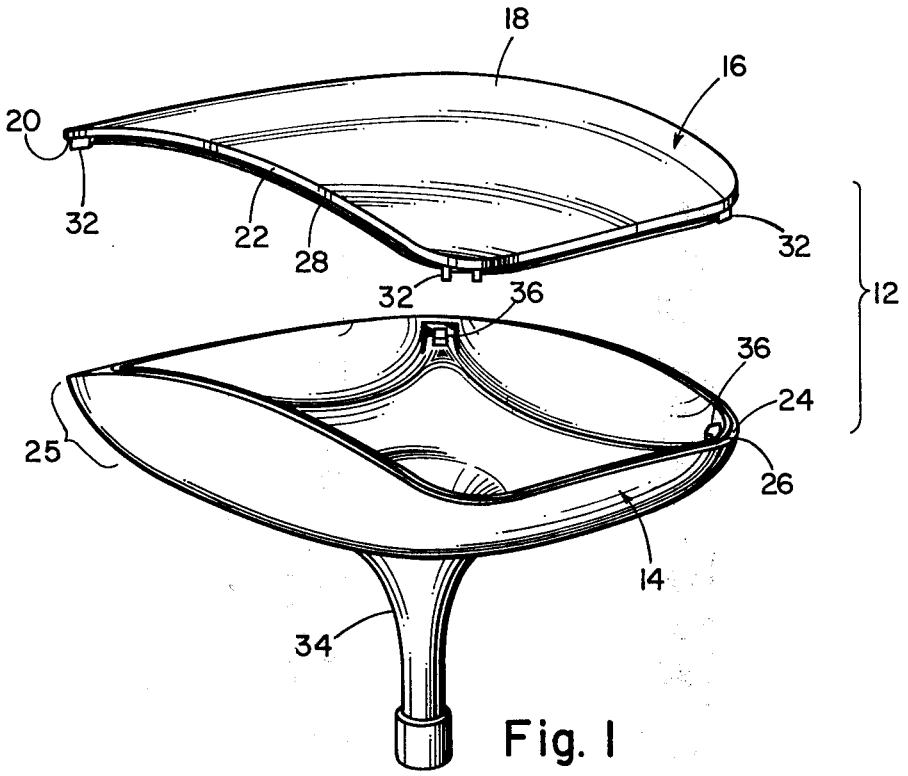

Whereas the method of this invention may be applied to color cathode ray tubes of various types, it is preferably applied to a tube of the nature shown in FIG. 1. The tube, as illustrated in FIG. 1, has a bulb 12 comprising a funnel 14 sealed to a flangeless faceplate 16. The novel construction of the faceplate 16 without a flange permits economies in manufacture of the envelope and simplified and economical screening and assembly processes. The faceplate 16 has a curved configuration which may be spherical, multi-radial, cylindrical, or of other suitable curvature. The faceplate 16 has a convex front surface 18, a concave rear surface 20, and a peripheral edge surface 22.

The funnel 14 has a convex seal land 24 on its flared portion 25, herein intended to mean a seal land which lies on an imaginary curved surface, which surface curvature may be spherical, multi-radial, cylindrical, or of other suitable curved configuration. The seal land 24 of the funnel 14 is curved to match and mate with the concave rear surface 20 of the faceplate 16 along a sealing interface. The seal land 24 is hermetically bonded to the rear surface 20 of the faceplate 16 by a devitrifying glass solder, herein termed a "frit material" 26.

The concave rear surface 20 of the faceplate 16 is here shown as being slightly larger than the flared end of the funnel 14 to which the faceplate 16 is attached. Thus, when the tube 10 is assembled, the faceplate 16 overhangs the funnel 14 slightly. Alternatively, the faceplate edge surface 22 may be flush with the outside surface of the funnel 14.

The faceplate 16 has four shadow mask suspension studs 32 extending from its rear surface 20, one in each peripheral corner region of the faceplate 16. A shadow mask 28 is suspended from the studs 32.

The rectangularly cross-sectioned flared portion 25 of the funnel 14 has at least three corner notches 36 located inside the funnel 14 near the seal land 24. The notches 36 and the faceplate studs 32 constitute an internal referencing system for the faceplate 16 and the funnel 14, and insure correct alignment of the shadow mask 28 with an electron gun assembly which is mounted in the neck 34 of the funnel 14.

In the manufacture of rectangular shadow mask-type color television picture tubes the faceplate 16 must be sealed to the funnel 14 at its flared end. Several problems are encountered in assembling the faceplate 16 to the funnel 14. During assembly the studs 32 must engage the corner notches 36 in the funnel 14. When the assembly of the faceplate 16 and the funnel 14 is done by hand it is not possible to see whether the alignment of the studs 32 and notches 36 is correct. Frequently, an operator holding the faceplate 16 will bump a stud 32 against the frit material 26. This is undesirable in that it is apt to create a defect in the seal of the faceplate 16 to the funnel 14 at the point at which the frit material 26 is nicked or knocked off of the seal land 24. Also, part of this frit material 26 which was hit by the stud 32 may fall down into the funnel 14, thereby causing problems in the operation of the tube when it is fully assembled and evacuated. To eliminate these problems of assembly, the faceplate 16 must be in alignment with funnel 14 before they are assembled. That is, the studs 32 must be in alignment with the notches 36. The alignment needed is of a very high precision and practicably cannot be done by hand. By the method of this invention such alignment can be achieved with this unique tube.

Figure 2:
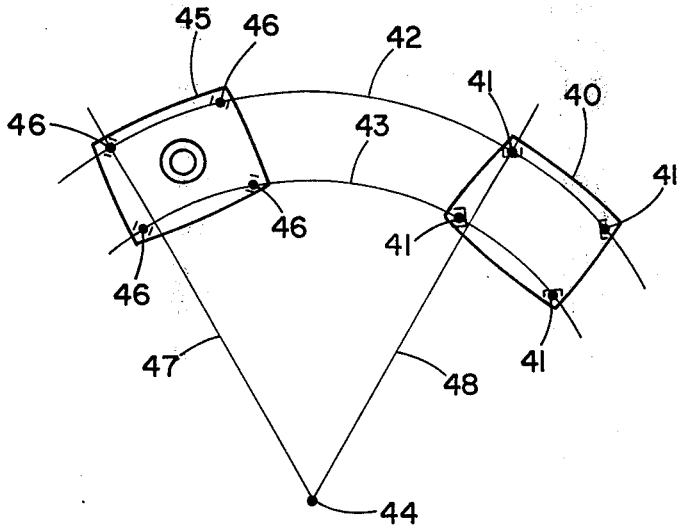

An important aspect of the method of this invention is a concept referred to as theta referencing. The term theta referencing as used in this application refers to the relationship of the angular orientation of the faceplate and the funnel. FIG. 2 shows a faceplate 40 positioned such that the studs 41 on the faceplate lie on circumferences 42 and 43 about pivot axis 44. The angular position of the faceplate 40 on the circumferences is called its theta position. Correspondingly, a funnel 45 is positioned such that its notches 46 also lie on circumferences 42 and 43. The angular position of the funnel 45 is termed the funnel theta position.

If the funnel 45 is moved such that its notches 46 remain on circumferences 42 and 43, that is, the funnel is swung about pivot axis 44 at a constant distance and without altering its position relative to a radius, the relationship of the angular position of the notches 46 to the studs 41 is always known and the theta referencing on the funnel 45 to the faceplate 40 is preserved. It is important to note that the funnel 45 and faceplate 40 are not in the same plane. The faceplate 40 is positioned in a plane above the funnel 45. When the funnel 45 is swung about pivot axis 44 to a position where funnel radial 47 is coincident with faceplate radial 48, the funnel notches 46 will lie directly below faceplate studs 41. The faceplate 40 may then be lowered until studs 41 engage notches 46.

In general, the method of this invention involves orienting the faceplate, concave rear surface down, such that a central axis of the faceplate is parallel to a predetermined reference axis and such that the faceplate is angularly positioned to coincide with a predetermined faceplate theta position. The orienting of the faceplate is effected by engaging the studs on the faceplate with simulated funnel corner notches on a faceplate aligning means.

The funnel is oriented, flared portion up, such that a funnel central axis is parallel to the predetermined reference axis and such that the funnel is angularly positioned to coincide with a predetermined funnel theta position. The orienting of the funnel is effected by engaging the corner notches in the funnel with simulated studs on a funnel aligning means. The simulated studs and simulated notches are theta-referenced each to the other, i.e. the angular orientation of each to the other is at all times known.

The faceplate is locked such that the faceplate central axis is parallel to the predetermined reference axis, and such that the theta referencing to the funnel is preserved. The faceplate aligning means is then disengaged from the faceplate. Likewise, the funnel is locked such that the funnel central axis is parallel to the predetermined reference axis and such that the theta referencing to the faceplate is preserved. The funnel aligning means is then disengaged from the funnel. Relative motion of the faceplate and funnel is effected parallel to the reference axis and in planes perpendicular to the reference axis while preserving the theta referencing, causing the studs on the faceplate to engage the notches in the funnel.

In a preferred execution, the method of this invention involves lowering the faceplate, concave rear surface down, onto a faceplate aligning means located at a predetermined distance from a predetermined pivot axis at a faceplate aligning radial position, the pivot axis being parallel to a predetermined reference axis. The studs on the faceplate engage simulated funnel corner notches on the faceplate aligning means, causing the faceplate central axis to be parallel to the predetermined reference axis and causing the faceplate to be angularly positioned to coincide with a predetermined faceplate theta position.

A funnel aligning means located at the predetermined distance from the predetermined pivot axis at a funnel aligning radial position is lowered into the funnel, positioned with flared portion up. The notches in the funnel engages simulated studs on the funnel aligning means, causing the funnel central axis to be parallel to the predetermined reference axis and causing the funnel to be angularly positioned to coincide with a predetermined funnel theta position.

The faceplate is locked such that the faceplate central axis is parallel to the predetermined reference axis, and such that the theta referencing to the funnel is preserved. The faceplate is then disengaged from the faceplate aligning means, disengaging the simulated funnel notches from the faceplate studs. Correspondingly, the funnel is locked such that the funnel central axis is parallel to the predetermined reference axis and such that the theta referencing to the panel is preserved. The funnel is then disengaged from the funnel aligning means, disengaging the simulated studs from the notches in the flared portion of the funnel. Relative angular movement is effected between the funnel and faceplate about the pivot axis to bring the notches and studs into coincident angular alignment but spaced in a direction parallel to the reference axis. Relative movement is then effected between the funnel and faceplate parallel to the reference axis to cause engagement of the studs in the notches.

Figure 3A:
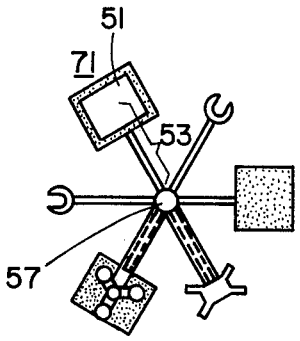
Figure 3B:
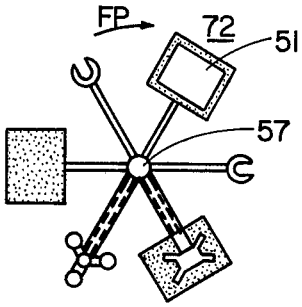
Figure 3C:
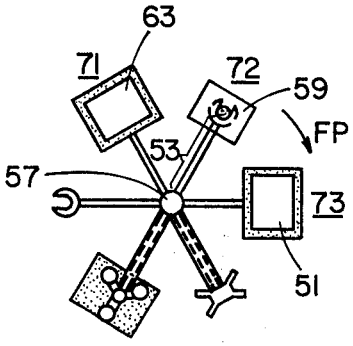
Figure 3D:
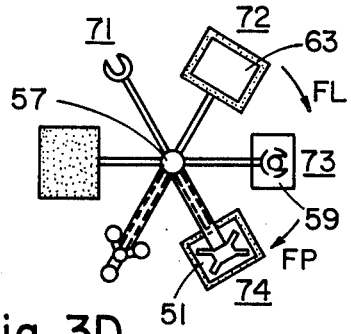
Figure 3E:
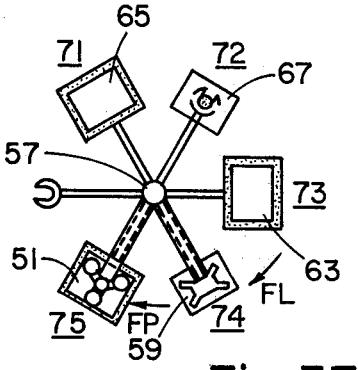
Figure 3F:
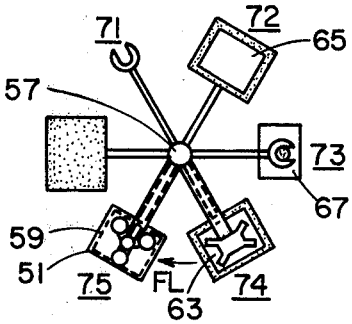
Figure 3G:
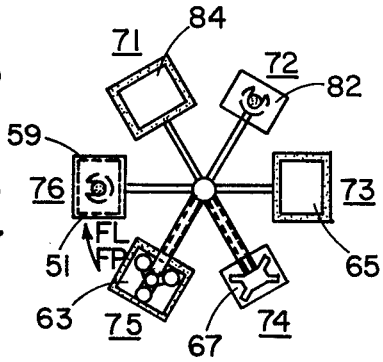

The various operations in the method of this invention will now be described in much more detail and are schematically illustrated in FIGS. 3A to 3G and FIGS. 4A to 4C. The first step of the process described above in general terms is the orienting of the faceplate, FIG. 3A shows a first faceplate 51 which is supported on a faceplate holding means. The faceplate holding means is located at a predetermined distance 53 from a predetermined pivot axis 57 at an initial panel radial position 71. The faceplate 51 is swung clockwise about the predertermined pivot axis 57 at the predetermined distance 53 to the radial position 72 shown in FIG. 2B. The apparatus used in the method of this invention has six indexing positions.

First faceplate 51 now moves to radial position 73, shown in FIG. 2C. In addition, a first funnel 59 is supported, flared portion up, on a funnel holding means having a loose fitting friction yoke. The yoke is attached to a magnetically lockable gimbal means. The funnel support means is located at the predetermined distance 53 from the predetermined pivot axis 57 at an initial funnel radial position 72. Also, a second faceplate 63 is supported on another faceplate holding means at radial position 71. FIG. 2D shows the apparatus having indexed clockwise once again so that the first faceplate 51 occupies radial position 74, the first funnel 59 occupying radial position 73, and the second faceplate 63 occupying radial position 72.

Figure 4A:
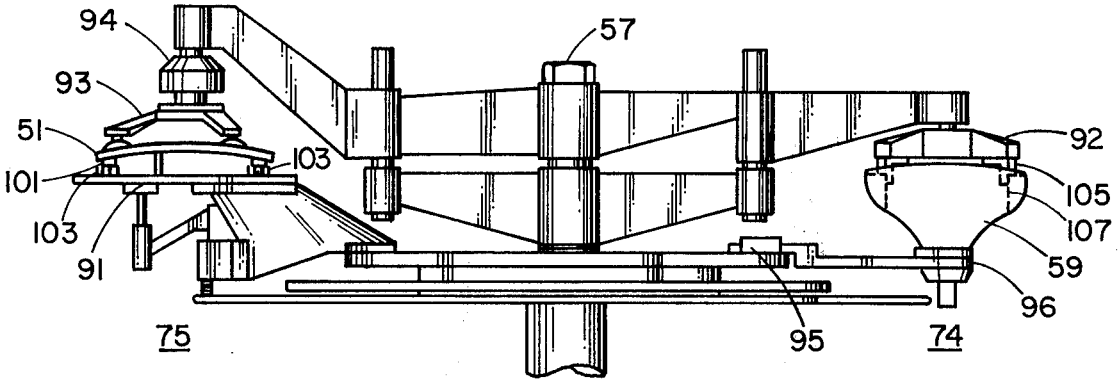
Figure 4B:
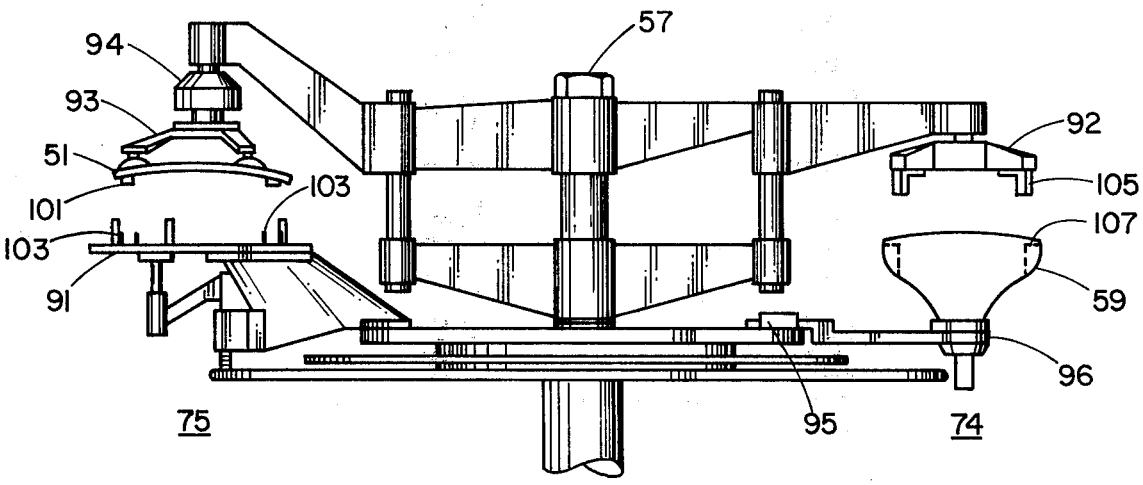
Figure 4C:
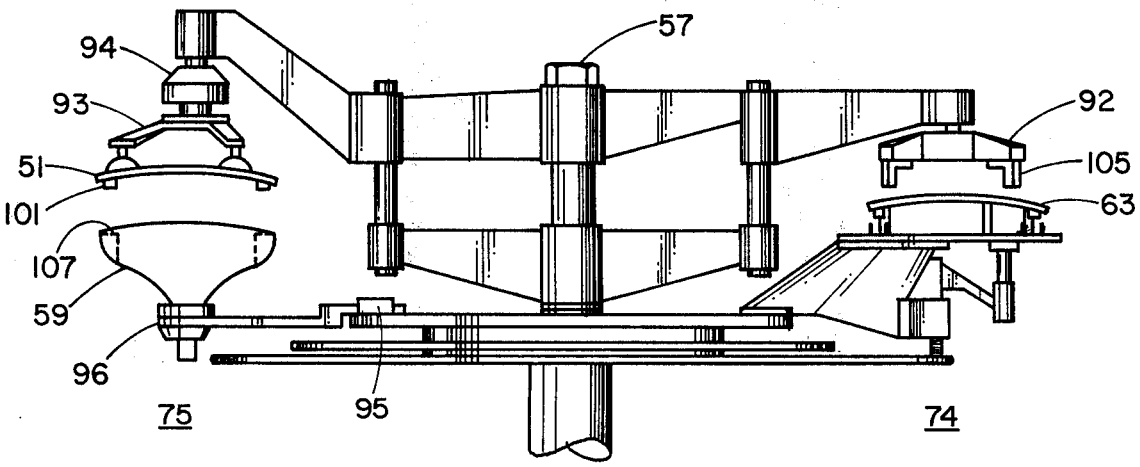

FIG. 2E shows a third faceplate 65 and a second funnel 67 positioned respectively at radial positions 71 and 72. Second faceplate 63 occupies radial position 73. Referring now also to FIG. 4A–4C, first faceplate 51 at faceplate aligning radial position 75 is lowered onto a faceplate aligning means 91, the studs 101 on the faceplate 51 engage simulated funnel corner notches 103 on the faceplate aligning means 91. This causes the faceplate central axis to be parallel to a predetermined reference axis and also causes the faceplate 51 to be angularly positioned to coincide with a predetermined reference faceplate theta position. Concurrently, a funnel aligning means 92 at funnel aligning radial position 74 is lowered into the first funnel 59. Simulated studs 105 on the funnel aligning means 92 engage the notches 107 in the first funnel 59 causing the funnel central axis to be parallel to the predetermined reference axis and also causing the predetermined 59 to be angularly positioned to coincide with a predeterming funnel theta position. The simulated studs 105 and the simulated notches 103 are theta referenced each to the other, i.e., the angular orientation of each to the other is at all times known. Once the faceplate 51 and funnel 59 have been positioned, movement thereafter of the faceplate 51 or funnel 59 about the pivot axis 57 is possible without loss of the theta relationship of the faceplate 51 to the funnel 59.

A faceplate pickup means 93 attached to a magnetically lockable gimbal 94 is lowered and attached to the first faceplate 51. The faceplate pickup means 93 is secured to the faceplate 51. The magnetic gimbal 94 is then locked such that the faceplate central axis is parallel to the predetermined reference axis and such that the theta referencing to the funnel 59 is preserved. The faceplate is then raised with the faceplate pickup means 93 from the faceplate aligning means 91. This disengages the simulated funnel notches 103 from the panel studs 101. The gimbal means 95 on the funnel support means 96 is magnetically locked such that the funnel central axis is parallel to the predetermined reference axis and such that the theta referencing to the panel 51 is preserved. The funnel aligning means 92 is then raised, disengaging the simulated studs 105 from the notches 107 in the flared portion of the funnel 59.

In FIG. 2F the apparatus has indexed and has swung the first funnel 59 about the predetermined pivot axis 57 in a plane perpendicular to the reference axis to faceplate aligning radial position 75, to bring the notches and studs into coincident angular alignment, but spaced in a direction parallel to the reference axis. This preserves the theta referencing and the funnel is now located directly below the first faceplate 51. The second faceplate 63 occupies the radial position 74, the second funnel 67 occupies radial position 73 and the third faceplate 65 occupies radial position 72. The first faceplate 51 is now lowered onto the first funnel 59 until the studs 101 on the first faceplate 51 engage the notches 107 in the first funnel 59. The faceplate pickup means 93 is then disengaged from the faceplate 51 and the assembled faceplate-funnel is removed from the funnel support means at radial position 76 in FIG. 2G. Also shown in FIG. 2G is a fourth funnel 82 in radial position 72 and a fourth faceplate 84 in radial position 71. With the apparatus now fully loaded it continues to index about its six positions, assembling corresponding faceplates and funnels.

The invention is not limited to the particular details of the method depicted and other modifications and applications are contemplated. Certain changes may be made in the above-described method without departing from the true spirit and scope of the invention herein involved. It is intended, therefore, that the subject matter in the above depiction shall be interpreted as illustrative and not in a limiting sense.

What is claimed is:

1. For use in the manufacture of a rectangular shadow mask-type color television picture tube including a flangeless, curved faceplate having a central axis, a convex front surface, and a concave rear surface with a phosphor screen deposited on a central portion thereof, said faceplate also having four shadow mask suspension studs extending from said rear surface of said faceplate, one in each peripheral corner region of said faceplate, and a shadow mask suspended from said studs, said tube also including a funnel having a central axis and a neck attached to a rectangularly cross-sectioned flared portion, the flared portion having a seal land which mates with said concave rear surface of said faceplate, said seal land having deposited thereon a cement for sealing said faceplate to said funnel, the flared portion of said funnel also having corner notches in at least three corners of said funnel, said notches receiving said studs on said faceplate when said faceplate and funnel are assembled, said studs and said notches constituting an internal referencing system for said faceplate and said funnel, a method for assembling said faceplate to said funnel comprising:

orienting said faceplate, concave rear surface down, with said faceplate central axis parallel to a predetermined reference axis and said faceplate being angularly positioned to coincide with a predetermined faceplate theta position, said orienting being effected by engaging said studs on said faceplate with simulated funnel inside corner notches on a faceplate aligning means;

orienting said funnel, flared portion up, with said funnel central axis parallel to said predetermined reference axis and with said funnel angularly positioned to coincide with a predetermined funnel theta position, said orienting being effected by engaging said notches in said funnel with simulated studs on a funnel aligning means, said simulated studs and said simulated notches being theta-referenced each to the other, i.e., the angular orientation of each to the other is at all times known;

locking said faceplate such that said faceplate central axis is parallel to said predetermined reference axis, and such that said theta referencing to said funnel is preserved;

disengaging said faceplate aligning means from said faceplate;

locking said funnel such that said funnel central axis is parallel to said predetermined reference axis and such that said theta referencing to said faceplate is preserved;

disengaging said funnel aligning means from said funnel;

effecting relative motion of said faceplate and said funnel parallel to said reference axis and in planes perpendicular to said reference axis while preserving said theta referencing to cause said studs on said faceplate to engage said notches in said funnel.

2. The method defined in claim 1 wherein said faceplate is oriented by lowering said faceplate onto said faceplate aligning means which is located at a predetermined distance from a predetermined pivot axis at a faceplate aligning radial position, said pivot axis being parallel to said reference axis.

3. The method defined in claim 2 wherein said funnel is oriented by lowering into said funnel said funnel aligning means which is located at said predetermined distance from said predetermined pivot axis at a funnel aligning radial position.

4. The method defined in claim 3 wherein said faceplate and said funnel are oriented concurrently.

5. The method defined in claim 3 wherein said relative motion of said faceplate and said funnel is effected by a relative angular movement between said funnel and faceplate about said pivot axis to bring said notches and studs into coincident angular alignment but spaced in a direction parallel to said reference axis and effecting relative movement between said funnel and faceplate parallel to said reference axis to cause engagement of said studs in said notches.

6. For use in the manufacture of a rectangular shadow mask-type color television picture tube including a flangeless, curved faceplate having a central axis, a convex front surface, and a concave rear surface with a phosphor screen deposited on a central portion thereof, said faceplate also having four shadow mask suspension studs extending from said rear surface of said faceplate, one in each peripheral corner region of said faceplate, and a shadow mask suspended from said studs, said tube also including a funnel having a central axis and a neck attached to a rectangularly cross-sectioned flared portion, the flared portion having a seal land which mates with said concave rear surface of said faceplate, said seal land having deposited thereon a cement for sealing said faceplate to said funnel, the flared portion of said funnel also having corner notches in at least three corners of said funnel, said notches receiving said studs on said faceplate when said faceplate and funnel are assembled, said studs and said notches constituting an internal referencing system for said faceplate and said funnel, a method for assembling said faceplate to said funnel comprising:

lowering said faceplate, concave rear surface down, onto a faceplate aligning means which is located at a predetermined distance from a predetermined pivot axis at a faceplate aligning radial position, said pivot axis being parallel to a predetermined reference axis, to orient said faceplate such that a faceplate central axis is parallel to said reference axis and such that said faceplate is angularly positioned to coincide with a predetermined faceplate theta position, said orienting being effected by engaging said studs on said faceplate with simulated funnel inside corner notches on said faceplate aligning means;

positioning said funnel with its flared position up and lowering into said funnel a funnel aligning means located at said predetermined distance from said predetermined pivot axis at a funnel aligning radial position, to orient said funnel such that a funnel central axis is parallel to said predetermined reference axis, and such that said funnel is angularly positioned to coincide with a predetermined funnel theta position, said orienting being effected by engaging said notches in said funnel with simulated studs on said funnel aligning means, said simulated studs and said simulated notches being theta-referenced each to the other, i.e., the angular orientation of each to the other is at all times known;

locking said faceplate such that said faceplate central axis is parallel to said predetermined reference axis, and such that said theta referencing to said funnel is preserved;

disengaging said faceplate aligning means from said faceplate;

locking said funnel such that said funnel central axis is parallel to said predetermined reference axis and such that said theta referencing to said faceplate is preserved;

disengaging said funnel aligning means from said funnel;

effecting relative angular movement between said funnel and faceplate about said pivot axis to bring said notches and studs into coincident angular alignment but spaced in a direction parallel to said reference axis and effecting relative movement between said funnel and faceplate parallel to said reference axis to cause engagement of said studs in said notches.

7. The method defined in claim 6 wherein, before lowering said faceplate onto said faceplate aligning means, said faceplate is supported, concave rear surface down, on a faceplate-holding means located at said predetermined distance from said predetermined pivot axis at an initial faceplate radial position, said faceplate and faceplate-holding means being then swung about said pivot axis to said faceplate aligning radial position.

8. The method defined in claim 6 wherein, before lowering said funnel aligning means into said funnel, said funnel is supported, flared portion up, on a funnel support means at said predetermined distance from said predetermined pivot axis at an initial funnel radial position, said funnel and said funnel support means being then swung about said pivot axis to said funnel aligning radial position.

9. The method defined in claim 8 wherein said funnel support means comprises a loose-fitting friction yoke attached to a magnetically lockable gimbal means.

10. The method defined in claim 6 wherein said faceplate is raised from said faceplate aligning means by attaching to said faceplate a faceplate pickup means having a magnetically lockable gimbal means.

11. For use in the manufacture of a rectangular shadow mask-type color television picture tube including a flangeless, curved faceplate having a central axis, a convex front surface, and a concave rear surface with a phosphor screen deposited on a central portion thereof, said faceplate also having four shadow mask suspension studs extending from said rear surface of said faceplate, one in each peripheral corner region of said faceplate, and a shadow mask suspended from said studs, said tube also including a funnel having a central axis and a neck attached to a rectangularly cross-sectioned flared portion, the flared portion having a seal land which mates with said concave rear surface of said faceplate, said seal land having deposited thereon a cement for sealing said faceplate to said funnel, the flared portion of said funnel also having corner notches in at least three corners of said funnel, said notches receiving said studs on said faceplate when said faceplate and funnel are assembled, said studs and said notches constituting an internal referencing system for said faceplate and said funnel, a method for assembling said faceplate to said funnel comprising:

supporting said faceplate, concave rear surface down, on a faceplate-holding means located at a predetermined distance from a predetermined pivot axis at an initial faceplate radial position;

swinging said faceplate and said faceplate-holding means about said predetermined pivot axis at said predetermined distance to a faceplate aligning radial position;

lowering said faceplate, concave rear surface down, onto a faceplate aligning means which is located at a predetermined distance from a predetermined pivot axis at said faceplate aligning radial position, said pivot axis being parallel to said reference axis, to orient said faceplate such that a faceplate central axis is parallel to a predetermined reference axis and such that said faceplate is angularly positioned to coincide with a predetermined faceplate theta position, said orienting being effected by engaging said studs on said faceplate with simulated funnel inside corner notches on said faceplate aligning means;

supporting said funnel, flared portion up, on a funnel holding means having a loose-fitting friction yoke attached to a magnetically lockable gimbal means, said funnel support means located at said predetermined distance from said predetermined pivot axis at an initial funnel radial position;

swinging said funnel and said funnel support means about said predetermined pivot axis at said predetermined distance to a funnel aligning radial position;

positioning said funnel with its flared portion up and lowering into said funnel a funnel aligning means, located at said predetermined distance from said predetermined pivot axis at said funnel aligning radial position to orient said funnel such that a funnel central axis is parallel to said predetermined reference axis, and such that said funnel is angularly positioned to coincide with a predetermined funnel theta position, said orienting being effected by engaging said notches in said funnel with simulated studs on said funnel aligning means, said simulated studs and said simulated notches being theta-referenced each to the other, i.e., the angular orientation of each to the other is at all times known;

swinging said funnel about said predetermined pivot axis at said predetermined distance to said faceplate aligning radial position in a plane perpendicular to said reference axis to bring said notches and studs into coincident angular alignment but spaced in a direction parallel to said reference axis;

lowering said faceplate parallel to said reference axis until said studs on said faceplate engage said noches in said funnel;

disengaging said faceplate pickup means from said faceplate and removing said funnel and faceplate from said funnel support means.

* * * * *